US005086529A

United States Patent [19]

DeGroot

[11] Patent Number: 5,086,529

[45] Date of Patent: Feb. 11, 1992

[54] SEGMENTED SUPPORT ARTICLE

[76] Inventor: Linda J. DeGroot, 18204 W. Spring Lake Dr, SE, Renton, Wash. 98058

[21] Appl. No.: 557,097

[22] Filed: Jul. 25, 1990

[51] Int. Cl.[5] ..... A47C 27/10

[52] U.S. Cl. ..... 5/465; 5/461; 5/455

[58] Field of Search ..... 5/419, 420, 431, 435, 5/437, 441, 455, 461, 465

[56] References Cited

U.S. PATENT DOCUMENTS

| | | | |
|---|---|---|---|
| 717,703 | 1/1903 | McCarty | 5/465 |
| 1,548,728 | 8/1925 | Milam | 8/465 X |
| 2,623,574 | 12/1952 | Damsch | 5/455 X |
| 2,807,033 | 9/1957 | Austen | 5/461 |
| 2,843,181 | 7/1958 | Paschen | 5/441 X |
| 3,747,916 | 7/1973 | Benson | 269/322 |
| 3,902,759 | 9/1975 | Monteforte et al. | 5/465 X |
| 4,054,960 | 10/1977 | Pettit et al. | 5/357 |
| 4,473,913 | 10/1984 | Ylvisaker | 5/435 |
| 4,484,281 | 11/1984 | Phelps | 5/455 X |
| 4,518,203 | 5/1985 | White | 5/465 X |
| 4,603,444 | 8/1986 | Suits | 5/431 |
| 4,635,306 | 1/1987 | Willey | 5/465 X |
| 4,723,329 | 2/1988 | Vaccaro | 5/455 |
| 4,777,678 | 10/1988 | Moore | 5/431 |
| 4,824,411 | 4/1989 | McClanahan | 5/465 X |

OTHER PUBLICATIONS

"Standard Trade Index of Japan 1988-89, 32nd Ed.", The Japan Chamber of Commerce and Industry, Tokyo, Japan, Page Advertising the BRESCO® Sanken-Mat® Air-Ventilation Type Bedsore Remedy and Prevention Apparatus (Brethren Corporation) and the Bio-Up Ultra-Long Wave Magnetic Therapeutic Apparatus (Kawasaki Electric Industry Co., Ltd.).

*Primary Examiner*—Michael F. Trettel

*Attorney, Agent, or Firm*—Christopher John Rudy

[57] ABSTRACT

A segmented support article comprises at least four segments, head, second, third and fourth, attached successively one to another in a linear arrangement, with flexion hinges attached between said segments. The article may have an especially adapted pillow, and/or it may have a support strap, and it has body supportive and therapeutic utility.

8 Claims, 5 Drawing Sheets

SEGMENTED SUPPORT ARTICLE

FIELD

This invention concerns a segmented support article, its use for providing bodily support and its manufacture.

BACKGROUND

Various bodily support articles are known. Among these are included those described in the following U.S. Pat. No. 4,054,960 (Oct. 25, 1977) to Pettit et al., disclosing an inflatable body support cushion, particularly to support a woman during pregnancy; U.S. Pat. No. 4,473,913 (Oct. 2, 1984) to Ylvisaker, disclosing a therapeutic support cushion; U.S. Pat. No. 4,723,329 (Feb. 9, 1988) to Vaccaro, disclosing an air mattress; U.S. Pat. No. 4,777,678 (Oct. 18, 1988) to Moore, disclosing a method and apparatus for providing back support.

However, there are drawbacks to such known art. For instance, the device of the Pettit et al. patent does not continuously and flexibly support the abdomen during the course of the pregnancy while the degree of distension varies. Also, neck and facial muscles are unevenly supported because there is no opening for the face to enter to allow correct alignment.

A particularly troublesome problem is the lack of flexibility in current body support devices. Known air mattresses are primarily designed to be used in one position only, flat. They do not allow for body flexing, not being conducive for the body being able to attain a seated or partially elevated position, nor do they provide individually adjustable support to the various body parts.

Other art exists. See e.g. U.S. Pat. No. 3,747,916 (July 24, 1973) to Benson, disclosing a chiropractic table; "Standard Trade Index of Japan 1988-89, 32nd Ed., " The Japan Chamber of Commerce and Industry, Tokyo, Japan, advertising on the same page the BRESCO ® SANKEN-MAT ® air-ventilation type bedsore remedy and prevention apparatus (Brethren Corporation) and the Bio-up ultra-long wave magnetic therapeutic apparatus (Kawasaki Electric Industry Co., Ltd.).

Improvements in the art are yet desired. Solutions to problems therein have heretofore been sought.

SUMMARY

This invention provides a segmented support article, which comprises at least four segments, head, second, third and fourth, attached successively one to another in a linear arrangement, with at least three flexion hinges attached between the segments. Optionally, an especially adapted pillow accompanies appropriate embodiments of the article, and/or, means for securing segments are aplanarly attachable to segments on opposite sides of the flexion hinge(s).

The article is useful for providing bodily support, and appropriate embodiments especially can be therapeutically useful. It can be made by standard methods.

Notably, the article of this invention can support the entire body of a human being, with its body areas being supported such that they may remain in a relaxed state, without body parts being under tension, so as to maintain equilibrium, i.e., so that no major muscle group of the body is stressed, stretched, pulled or otherwise in tension unequally and so that bilateral symmetry and good muscle tone occur when the body is supported by the article. Thus, by appropriate employment of the article of this invention, body parts can be aligned in a normal curvature or alignment and thus may be kept from being tilted, flexed, tensed-up, rotated, or otherwise angularly dispositioned therefrom to cause undesired strain on larger individual muscles or on muscle groups. For example, the neck can be aligned straightly with the head and spine, thereby desirably relaxing muscles associated therewith. The article is adaptable for special use in a program of stress management and relaxation. In a word, removal of muscular stress from and provision of support to individual and/or several part(s) of the body, are extant.

Thus, the invention solves the problems in the art. Further advantages attend this invention as well.

DRAWINGS

The drawings form part of the specification hereof.

FIG. 1 is a perspective view of a segmented support article of this invention in planar positioning.

FIG. 2 a side view of the article as shown in FIG. 1.

FIG. 3 is a perspective view of the article of FIG. 1 in an aplanar positioning.

FIG. 4 a side view of the article as shown in FIG. 3.

FIG. 5 is a perspective view of the article of FIG. 1 in another aplanar positioning.

FIG. 6 a side view of the article as shown in FIG. 5.

Figure 1:
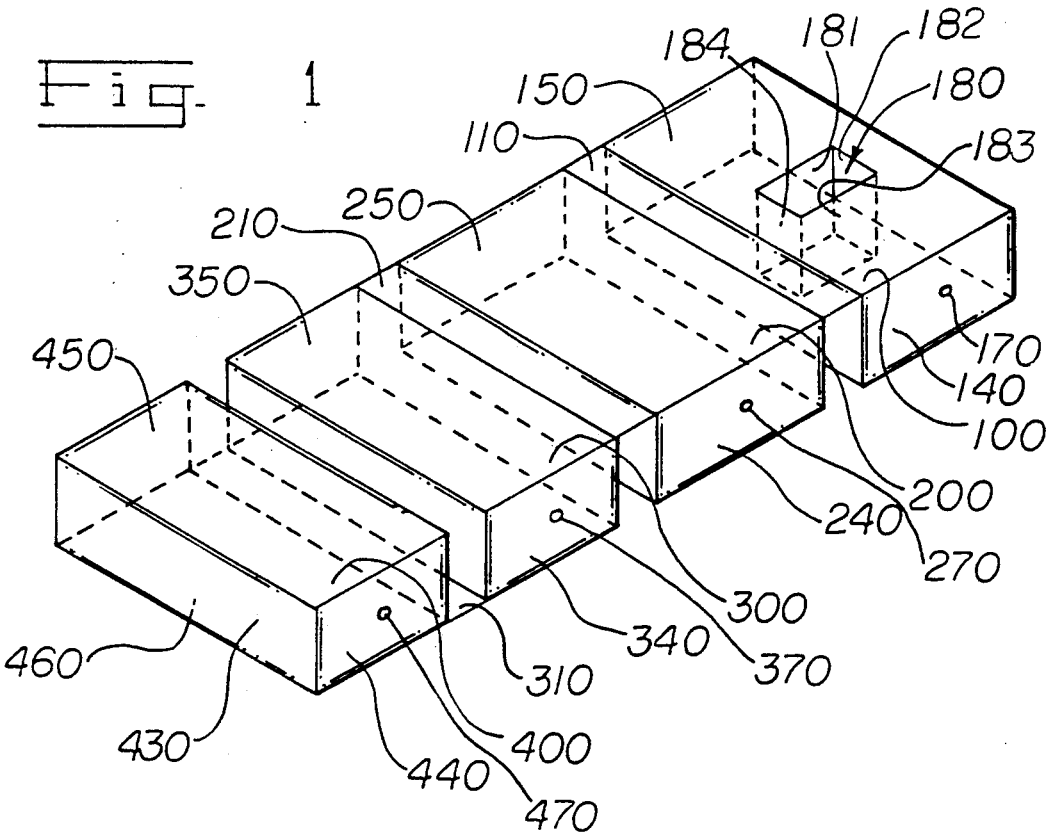
Figure 2:
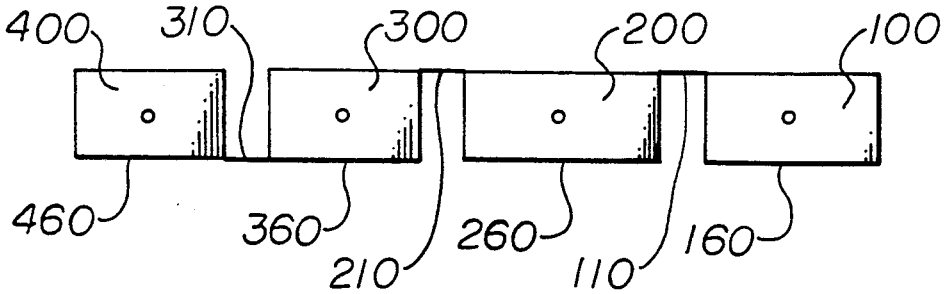
Figure 7:
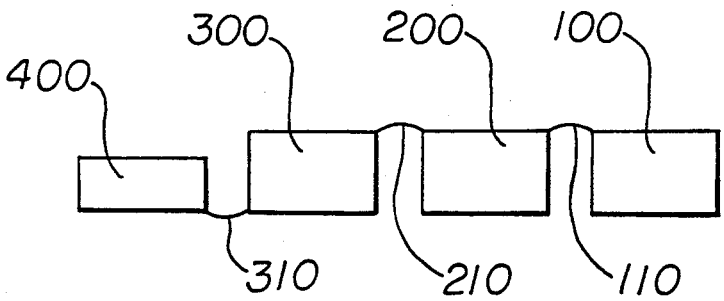
FIG. 7 is a side view of the article generally as of FIG. 1 but with its fourth segment lowered.
Figure 3:
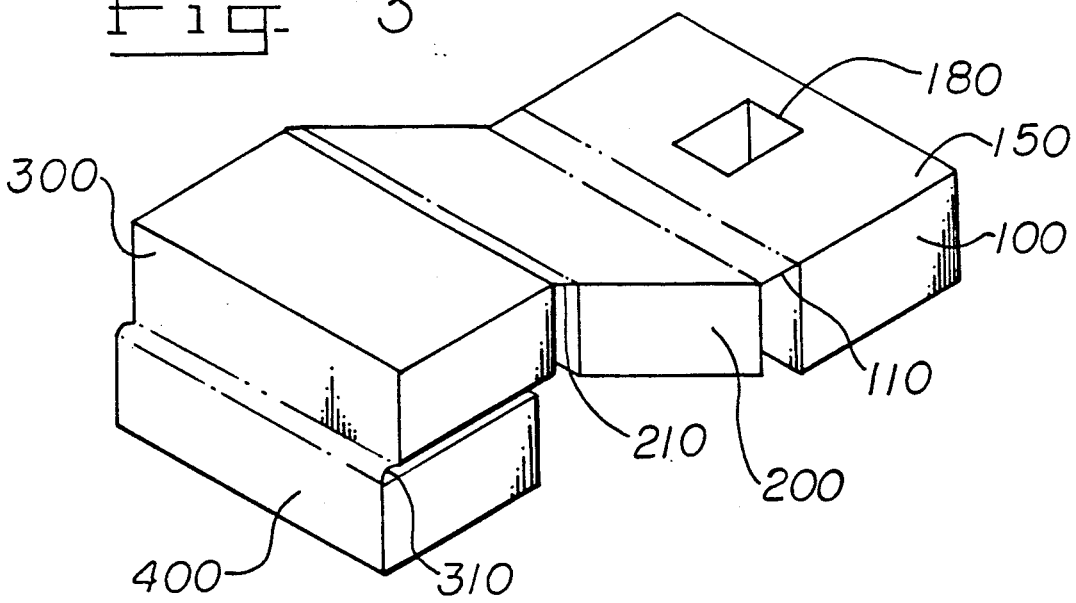
Figure 4:
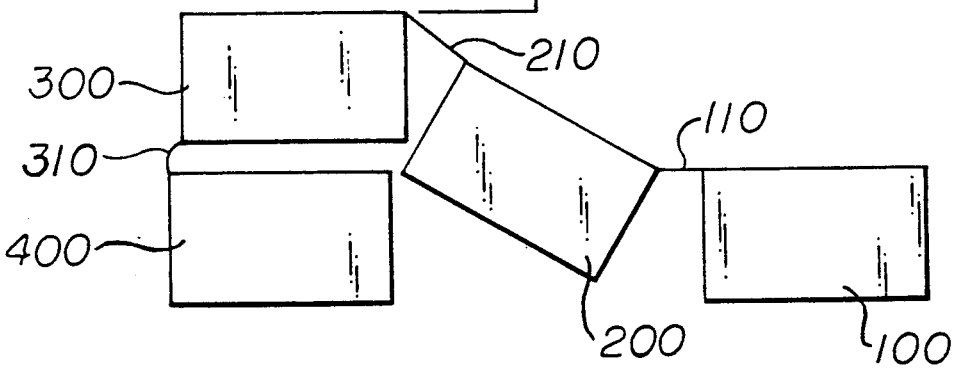
Figure 6:
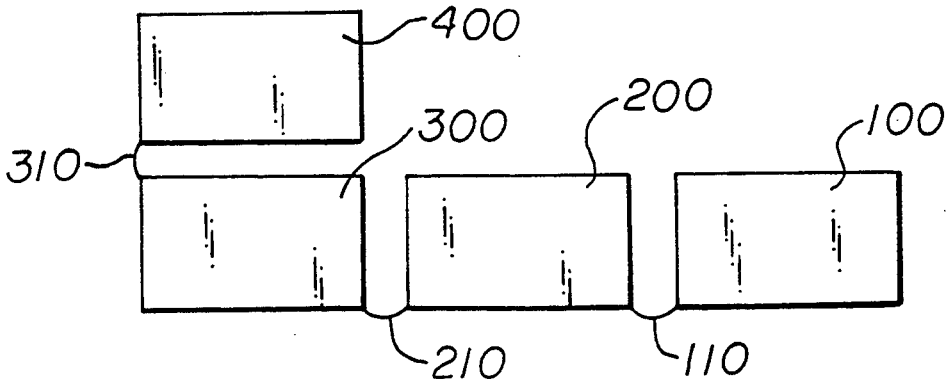
Figure 5:
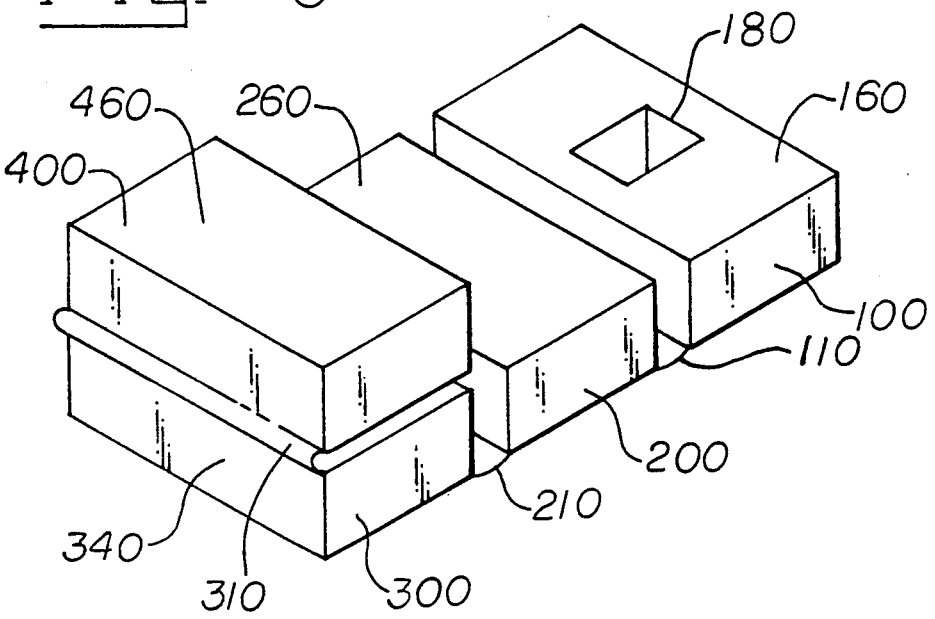
Figure 8:
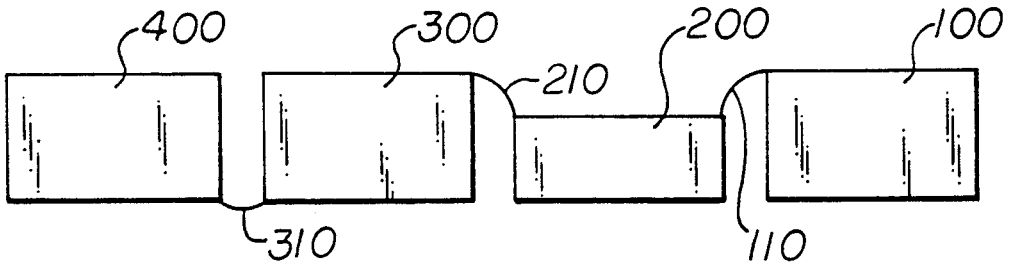
FIG. 8 is a side view of the article generally as of FIG. 1 but with its second segment lowered.
Figure 12:
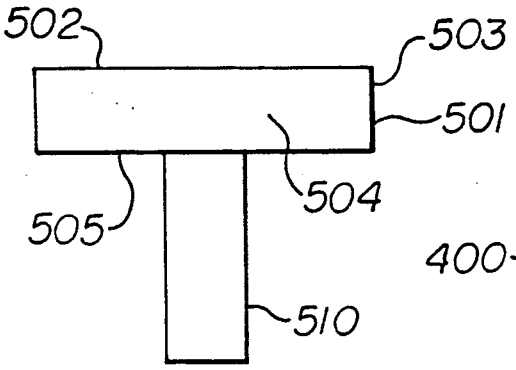
FIG. 12 is a side view of the pillow of FIG. 10 taken along the line 12—12.
Figure 9:
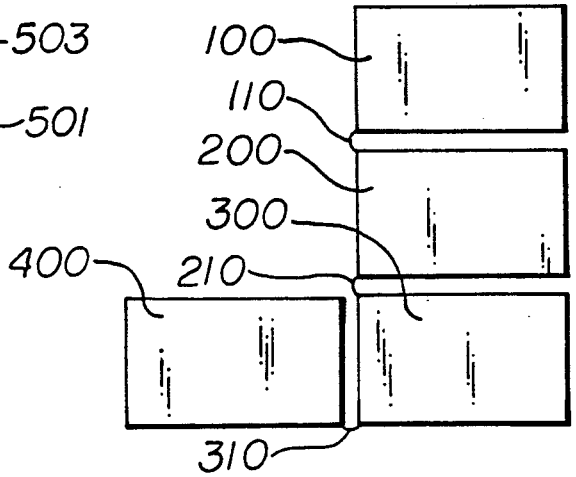
FIG. 9 is a side view of the article as shown in FIG. 1 in yet another aplanar positioning.
Figure 13:
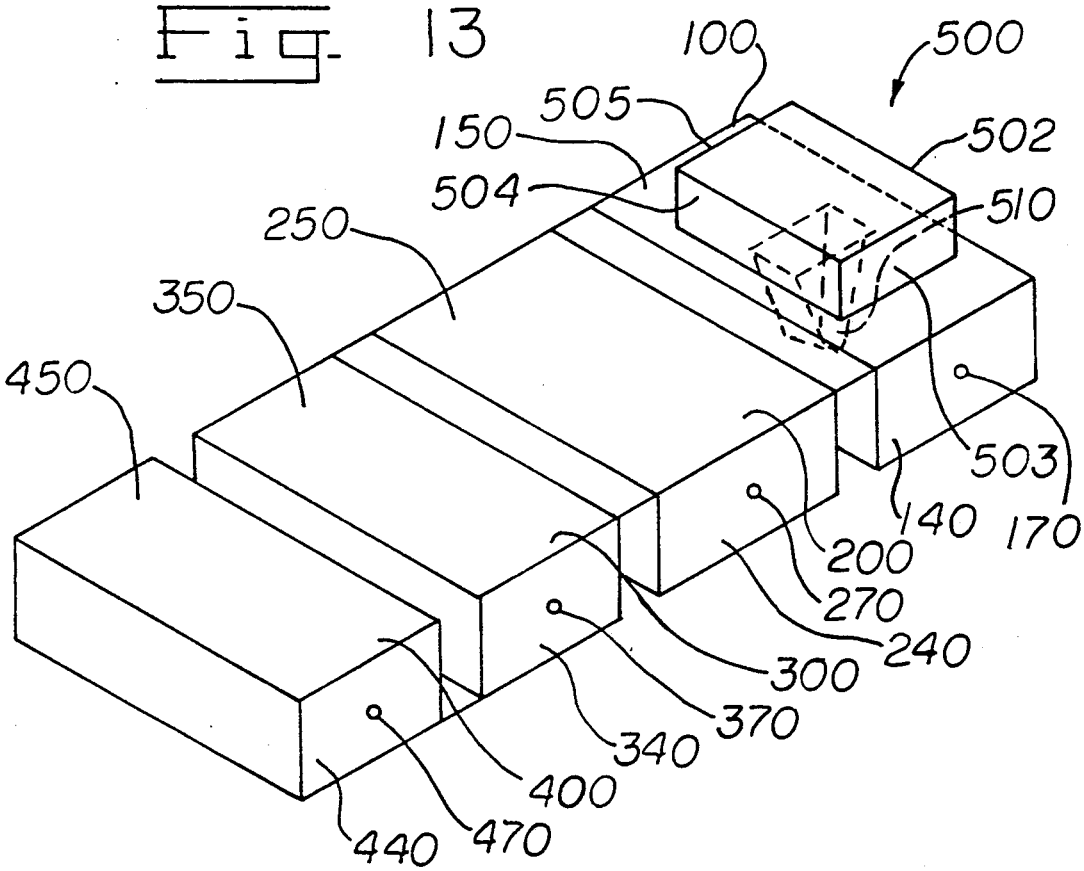
FIG. 13 is a perspective view of the article of FIG. 1 but with the pillow of FIG. 10.
Figure 14:
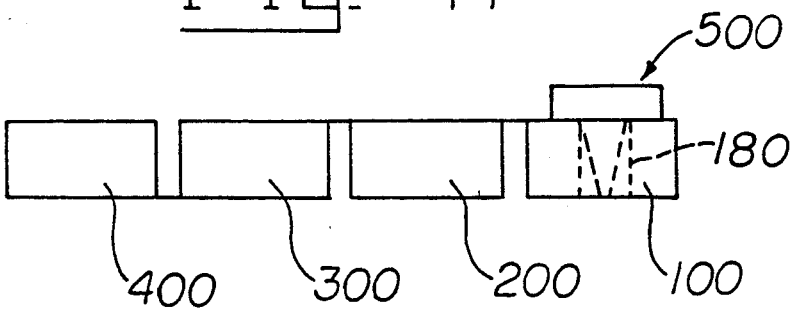
FIG. 14 is a side view of the article of FIG. 13.
Figure 10:
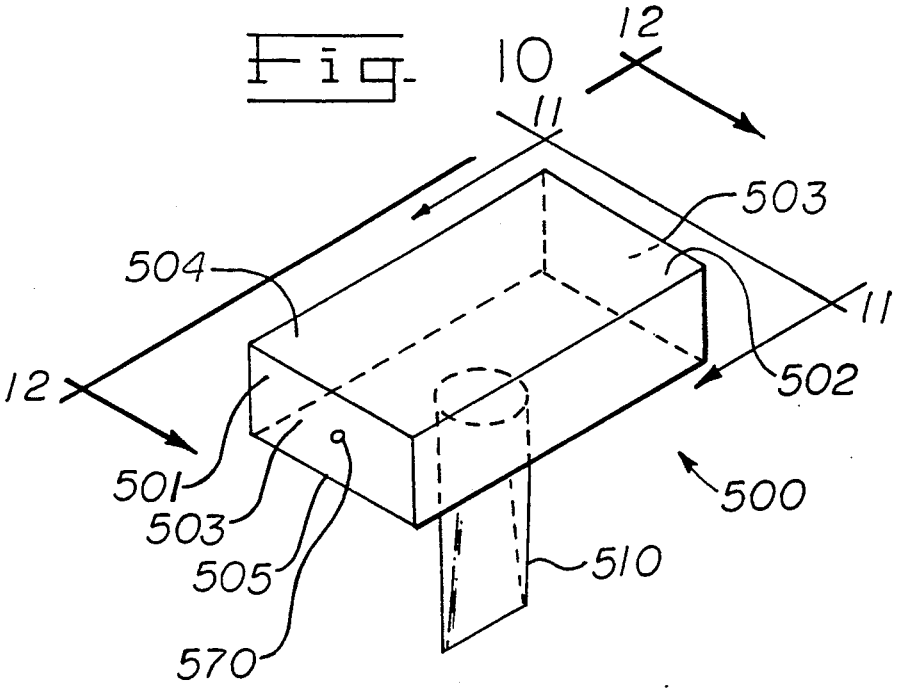
FIG. 10 is a perspective view of a cervical pillow adapted for the article of FIG. 1.
Figure 11:
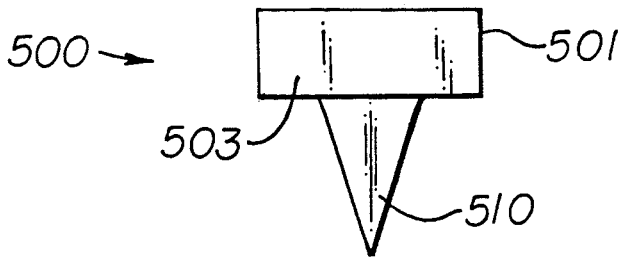
FIG. 11 is a side view of the pillow of FIG. 10 taken along the line 11—11.
Figure 15:
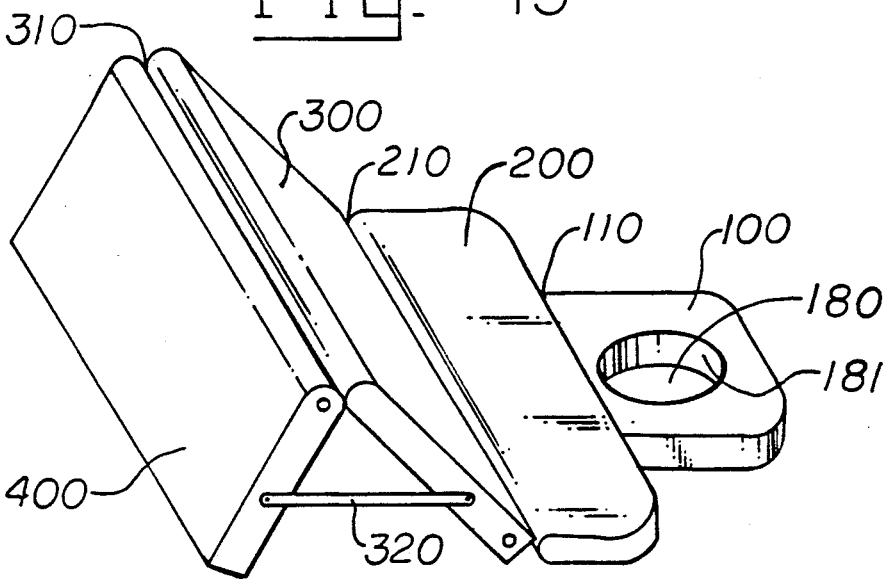
FIG. 15 is perspective view of another embodiment of a segmented support article of this invention, but with means for securing segments.

In reference to the drawings, some main features of articles of this invention are concisely noted in Table I.

TABLE I

| Feature Description | Feature Number(s) |
|---|---|
| Head Segment | 100 |
| Second Segment | 200 |
| Third Segment | 300 |
| Fourth Segment | 400 |
| Flexion Hinges | 110, 210 & 310 |

In reference to the drawings, other salient features of articles of this invention are concisely noted in Table II.

TABLE II

| Feature Description | Feature Number(s) |
|---|---|
| End Panels | 130 & 430 |
| Side Panels | 140, 240, 340 & 440 |
| Top Panels | 150, 250, 350 & 450 |
| Bottom Panels | 160, 260, 360 & 460 |
| Air Valves | 170, 270, 370, 470 & 570 |
| Face Opening | 180 |
| Face Opening Panels | 181, 182, 183 & 184 |

TABLE II-continued

| Feature Description | Feature Number(s) |
|---|---|
| Pillow | 500 |
| Pillow Head | 501 |
| Pillow Head Panels | 502, 503, 504 & 505 |
| Pillow Spike | 510 |
| Means for Securing . . . | 320 |

Illustrative Detail

In general, the article of this invention is segmented. It can provide bodily support. Hence, it is a segmented support article.

The article of this invention is made up of at least four segments: a head segment, a second segment, a third segment and a fourth segment. Of course, more than four segments may be included to make up the article of this invention. Preferably however, the article is made up essentially of the four required segments, with or without an optional pillow, for example, a cervical pillow. The pillow may be considered to be like a segment.

At least the four required segments are attached successively one to another in a linear arrangement. By this is meant that the head segment, residing near one end of the article, is attached to the second segment; the second segment is attached to the third segment, and the third segment is attached to the fourth segment, which resides near the other end of the article.

Segments may be made up of known materials such as those that make up ordinary bed mattresses, water beds, air mattresses and so forth and the like. Preferably, the segments are made up to be sealable such that they can hold a fluid, for example, water or air, especially air, with means for adjusting amounts of fluid sealed thereby, for example, valves, being present as well.

As such, the material, to cite only a few examples, may be of such textiles as cotton, linen, silk and so forth, of such other cloths as acrylics, nylons, rayons and so forth, of leather, and/or of such synthetic materials as extended sheets of such pliable polymeric resins, commonly termed plastics, as polymers or copolymers of polyethylenes, polypropylenes, polyvinylchloride (PVC) and so forth and the like, of rubbers, any or all with or without battings or stuffings as is known in the art to include cellulosics, polymer or copolymer beads or foams of polycarbonates, polyurethanes and/or ureas, styrenes, and so forth and the like. Especially preferred is the material used in making the air mattress embodiments of the article, the PVC, particularly when the PVC is used substantially in the making of such embodiments for segments and flexion hinges.

A flexion hinge is implaced between the head and second segments. Another flexion hinge is implaced between the second and third segments. Yet another flexion hinge is implaced between the third and fourth segments. Other flexion hinge(s) may be implaced between segments, say for example, between any other two adjacent segments perhaps present. The flexion hinges attach segments one to another.

Thus, each of the four required segments is connected by a flexion hinge to the required section adjacent it. The article, when considered to have a top and a bottom, preferably has two of the required flexion hinges attached on its top, the first between the head and second segments, and the second between the second and third segments, with the third required flexion hinge attached on the bottom of the article, between the third and fourth segments. The flexion hinges attached thus on top of the article can continue the support provided by those sections themselves, and the first and second flexion hinges can directly continue the support of the head, second and third segments. The oppositely placed flexion hinge, i.e., the one on the bottom, e.g., between the third and fourth segments, can analogously bridge the bottom of the article where it is s attached, providing for the multiplicity of positions attainable with the third and fourth segments. The placement of these hinges, to include this third hinge, along with the ability of one to completely flip the article over so that its "top" now becomes its "bottom," and vice versa, allows even greater variety in placement and arrangement of the segments, thus even further increasing the utility of the article.

The flexion hinge is a device or material that allows for relatively free angular displacement of the one section relative to the other section to which it is attached. It, for example, can be a standard hinge such as encountered in cabinetry, or can be a flexible material such as cloth, leather or a pliable polymeric resin attached to the segments between which it lies. Preferably however, the flexion hinge is made up of the same material with which the segments to which it is attached are both for the most part composed, and especially, the flexion hinges are made up of the same materials with which the segments of the whole article itself are for the most part composed.

If a flexion hinge is not present between segments, the segments may be connected by means of snap fasteners, hook and loop fasteners, and so forth. Herein, such are termed simple connections.

Optionally, a pillow is associated with the article. Preferably, the pillow is the cervical pillow, which is inflatable, and which can have a head portion, upon which the head and neck of a person may rest, and a spike portion attached to the head portion, adapted for insertion into the face hole of the head segment of the article so that a reasonably tight and secure fit is accomplished by such insertion. The spike portion can be inflatable along with the head portion, or it may be separately inflatable or simply always distended such as by making it from a foam.

Optionally, means for securing segments attached to at least one of the flexion hinges is present. It is capable of securing the segments attached to a flexion hinge in an aplanar, or angularly displaced, position. It is attachable to segments on opposite sides of the flexion hinge under consideration. The means can be a simple strap, say for example, of a rod or a chain link of metal, suitable plastic resin or wood, cloth, leather or a pliable polymeric resin, attachable on one or both ends thereof by buttons, glue, heating, hooks, snaps, VELCRO, and so forth and the like. Preferably however, this means is absent from the article.

A frame may be present. The frame can be of metal, plastic and/or wood, and it may have springs, slats and/or webbing and so forth and the like included therewith. Preferably however, no frame is present with the article.

The article may be one of a number of general shapes and sizes. Preferably however, the article is generally rectangular, which however, can include a radially extending portion on the head segment and/or an opening, say, in the head portion, and is generally about the size of a human body, infant or adult, to include a woman with child.

Especially preferred is an article embodiment of this invention having the following characteristics: The article is made as an air mattress, with valves on each of the segments thereof. Through the valves, air can be let in or let out of each segment independently to suit the desires of a practitioner of this invention. Accordingly, the article accommodates individual bodily characteristics, supporting the entire body, to include its head and neck, shoulders, upper thorax, lower thorax and hips, to include an unborn baby carried by a pregnant mother, upper legs, lower legs, ankles and feet, as supported, say, in supine or in prone positions. The separate valves allow for adjustments in contained air to suit the overall weight of an individual and to suit the weight of particular body parts, allowing relaxation of separate body parts, which assists in relaxing the whole body. The entire article is in general about three feet or so wide, about six to seven feet or so long, and about eight to ten inches or so in height. The optional cervical pillow is in general less than about one foot by one-half foot by one-fourth foot, or so. More exact salient dimensions of certain features of the article, made with PVC, to include the required and other features, are set forth in Table III.

TABLE III

| Feature | Length | Width | Height | Other |
|---|---|---|---|---|
| Head Segment | 18" | 3' | 10" | 1" radius corners |
| Face Opening | 14" | 5" | 10" | 1" radius corners |
| Flexion Hinge #1 | 4" | 3' | | PVC |
| Second Segment | 18" | 3' | 10" | 1" radius corners |
| Flexion Hinge #2 | 4" | 3' | | PVC |
| Third Segment | 18" | 3' | 10" | 1" radius corners |
| Flexion Hinge #3 | 4" | 3' | | PVC |
| Fourth Segment | 18" | 3' | 10" | 1" radius corners |
| Pillow Head | 9" | 4½" | 2¼" | (Spike length 5") |

The head segment supports the head, neck and shoulders. The pillow can assist in this function, particularly with respect to the head and neck. The pillow can be made to for stable attachment to the head segment such as by its having a portion thereof insertable into the face opening of the head segment. The first flexion hinge bridges in support of those body parts supported by the head and second segments.

The second segment supports the mid and lower back, lumbar area, mid-thoracic through lumbar sacral areas and tailbone (coccyx) area of the body to include its spine. The advantages of easing muscle tension and of spinal alignment as well as of being adjustable to individual body weight and shape are as readily apparent with respect to the second section as they are with respect to the head section, and so on.

The third segment begins its support of the body approximately at the coccyx. The second flexion hinge, between the second and third sections, advantageously plays a part in support when the user may selectively adjust the article, often by reducing the volume of the third segment, to relieve pressure on lower lumbar paraspinal muscles by flattening the lumbar curve. In other words, the pelvis, or hips, may be tilted and/or placed in a position relatively below the legs to increase comfort and/or other therapy considerations. The third section typically ends about the knees. Between the third and fourth segments is the third flexion hinge. Attachable to the third and fourth segments may be the means for support to allow for the securement of various positions concerning these sections.

The fourth segment supports the lower leg, ankle and foot extremities. Having the third and fourth segments connected by the third flexion hinge advantageously can allow for reduction in extension of the muscles in the dorsal side of the legs and lower back. Bending of the knees, of course, aids in relaxing paraspinal muscles. The ankles can be elevated, particularly if the fourth section is externally supported such as encountered by use of a suitable frame or foot pillow, or by adjusting the fourth segment to rest atop the third segment.

Appropriate article embodiments of the invention may find a variety of applications. These may include such applications as may be employed for home beds, for outdoor lawn furniture, for other recreational furniture such as, for example, used in general outdoor camping or for use at beaches and so forth, for hospital beds to include as may be used in surgical or recovery rooms to allow surgical and post-surgical body placement in positions other than a straight position such as when a body cast forces a patient to lie in a bent position, for prescription orthopedic devices for use in supporting injured, tired or stressed muscles, muscle groups or limbs in a desired position to allow for recuperation, such position often being one that the patient cannot maintain for a lengthy period of time without undue stress, for example, as with a broken arm, leg or hip, which would require immobilization in a bent position and/or elevation otherwise requiring pillows, slings, and so forth, to provide additional support, for chiropractic practice, to allow major muscle groups to equally maintain a state of proper tension, to allow the spinal and cervical alignment to return to proper position(s), to support stretched or flexed muscles as when one's back goes out of place and muscle groups contract painfully, for maternity support, to allow equal weight distribution and body support of a pregnant woman at any stage of the pregnancy and in positions which are comfortable and orthopedically correct but which other beds and mattresses do not allow, and for stress management, to allow the correct spinal and cervical alignments of major muscle groups in opposition, allowing the overall tension of the body to be reduced, thereby allowing relaxation for a more total wellness of the individual, body and mind.

Advantageously, the article, particularly as the especially preferred embodiments mentioned, can be used in supine or prone position methodologies.

In the supine position, the face opening of the head section cradles the head and neck. It primarily provides neck support. In addition, it provides support of the spine down to the mid-thoracic region by supporting the body mass of the head and neck. The cervical pillow may be used adjunctively, as may be appropriate. Typically, the head section aids in easing of upper body muscle tension, and the spine can be aligned with the head, with it being possible to put a normal curve in the neck. Since the head can be made to be not tilted to either side, as well as being not compressed or extended above or below its normal plane, no unnecessary, incorrect, one-sided strain, flexion or extension is placed on the upper body muscles. By using the cervical pillow to place a proper curve in the neck, proper traction can be obtained, thereby reducing unnecessary and improper strain on the whole body. Mid-thoracic support of the head, neck, shoulder and trapezius muscles, accomplishable from the shape of the article, and the appropriate placement and size of the face opening, into and upon which the body, neck and upper torso are placed, can relax the shoulders, trapezius muscles, and so forth, and can aid in spinal alignment. The separately adjustable valves allow for an increase or a decrease in air pressure to change rigidity and support characteristics to suit the individual user.

In the prone position, the head of the body is supported on its frontal bone and zygomatic arches (forehead and cheekbones). This can relax the chin. The face opening also allows the user to breath comfortably and further typically allows for obtaining a normal curvature and alignment. Thus, other proximate muscles can be relaxed. Generally, hyperextension is precluded. The air pressure may be adjusted in the head segment to variably support the upper thoracic area, which makes it possible, for example, to support and relax shoulder muscles that have been strained in a hunched-over position due to extended periods of secretarial-type work. The second segment may, of course, have its air pressure varied as well, allowing for adjustable lumbar support for people whose abdomens are not flat, for example, for pregnant women and people with protruding abdomens not caused by pregnancy. Also, big-breasted women, for example, pregnant or breast-feeding women, can have pressure on this section of their body adjusted and still recline in the face-down position. Thus, the back muscles can be relaxed, and the spine can be realigned to a more customary position. Thus, the spine can be realigned to a more customary position. The third segment may, too, have its air pressure varied. Typically, the hips, thighs and knees can be flexed by increasing the air pressure in the third segment while simultaneously decreasing the pressure in the second and/or fourth segment(s) to provide varied elevation of the body parts. Thus, pressure can be relieved on spinal discs. Also, a proper light traction can be maintained. Finally and again, the fourth segment may have its air pressure varied, which can be employed to appropriately support those lower leg and foot extremities as generally aforesaid.

Further advantages inherently attend this invention.

Conclusion

The present invention is thus provided. Numerous adaptations and modifications can be effected by those skilled in the art within the spirit of this invention, the asserted scope of which is particularly pointed out by the following distinctly claimed subject matter.

What is claimed is:

1. A segmented support article, which comprises four segments, head, second, third and fourth attached successively one to another in a linear arrangement, with three flexion hinges attached between segments, the first between the head and the second segments, the second between the second second and third segments, and the third between the third and fourth segments wherein the four segments are substantially the same length;

the segments are each independently adapted for adding and removing a fluid through a valve;

the first and second flexion hinges are positioned on one side of the article, and the third flexion hinge is positioned on a side opposite the position of the first and second flexion hinges, and the head segment has an opening for positioning an individual's head therein supported by its face, the individual being in a prone position and the opening being such that the individual can breathe while so positioned, such that the article can accommodate individual bodily characteristics and can support the individual's entire body, to include its head and neck, shoulders, upper thorax, lower thorax and hips, to include an unborn baby carried by a pregnant mother, upper legs, lower legs, ankles and feet, as supported in supine or prone positions, through use of the independent valves for each segment, which allow for adjustments in contained fluid to suit overall weight of the individual and to suit the weight of the individual and to suit the weight of particular body parts, allowing for relaxation of separate body parts, which can assist in relaxing the entire body.

2. The article of claim 1, wherein the fluid is air.

3. The article of claim 2, further comprising a pillow segment associatable with the article wherein the pillow segment has a head portion and a spike portion connected to the head portion, with the spike portion adaptable for insertion into the opening for positioning the individual's head and wherein the head portion of the pillow segment is about one foot by one-half foot by one-fourth foot in size.

4. The article of claim 12, wherein the flexion hinges are made of the same material as the segments are substantially made and wherein the entire article is about three feet wide by about six to seven feet long by about eight to ten inches high when fully filled with air.

5. The article of claim 1, further comprising a pillow segment associatable with the article, wherein the pillow segment has a head portion and a spike portion connected to the head portion, with the spike portion adaptable for insertion into the opening for positioning the individual's head.

6. The article of claim 1, further comprising a means for securing segments that is aplanarly attachable to the third and fourth segments and which is on a side opposite to of the third flexion hinge and wherein the entire article is about three feet wide by about six to seven feet long by about eight to ten inches high when fully filled with fluid.

7. The article of claim 1, wherein the flexion hinges are made of the same material as the segments are substantially made and wherein the entire article is about three feet wide by about six to seven feet long by about eight to ten inches high when fully filled with fluid.

8. The article of claim 1, which is made of polyvinylchloride and wherein the entire article is about three feet wide by about six to seven feet long by about eight to ten inches high when fully filled with fluid.

* * * * *

UNITED STATES PATENT AND TRADEMARK OFFICE

CERTIFICATE OF CORRECTION

PATENT NO. : 5,086,529

DATED : Feb. 11, 1992

INVENTOR(S) : Linda J. DeGroot

It is certified that error appears in the above-identified patent and that said Letters Patent is hereby corrected as shown below:

At column 8, line 35, i.e., claim 4, line 1:

DELETE "12" AND THEN

INSERT — 2 — THEREFOR.

Signed and Sealed this

Twenty-seventh Day of April, 1993

*Attest:*

MICHAEL K. KIRK

*Attesting Officer*

*Acting Commissioner of Patents and Trademarks*